United States Patent [19]

Riehl

[11] 3,938,944

[45] Feb. 17, 1976

[54] ELECTRIC IGNITION ASSEMBLY

[75] Inventor: Fred Riehl, Greensburg, Pa.

[73] Assignee: Robertshaw Controls Company, Richmond, Va.

[22] Filed: May 14, 1974

[21] Appl. No.: 469,720

[52] U.S. Cl. ..... 431/191; 126/39 E

[51] Int. Cl.[2] ..... F24C 3/10

[58] Field of Search ..... 431/191, 192, 193, 194, 431/263; 126/39 E

[56] References Cited

UNITED STATES PATENTS

| | | | |
|---|---|---|---|
| 2,360,608 | 10/1944 | Kauffman et al. | 431/191 X |
| 2,834,408 | 5/1958 | Reinhart et al. | 431/193 X |
| 3,823,345 | 7/1974 | Mitts et al. | 431/263 X |

*Primary Examiner*—Edward G. Favors

*Attorney, Agent, or Firm*—O'Brien and Marks

[57] ABSTRACT

An electric ignition assembly for a gas burner employs a resistance igniter element which is surrounded by a hood having an opening. A stream containing fuel is directed through the opening and along a surface portion above the igniter element so as not to directly impinge upon the igniter element. Facilities, such as a transversely extending wall or a tang, direct a portion of the stream into engagement with the igniter element.

14 Claims, 4 Drawing Figures

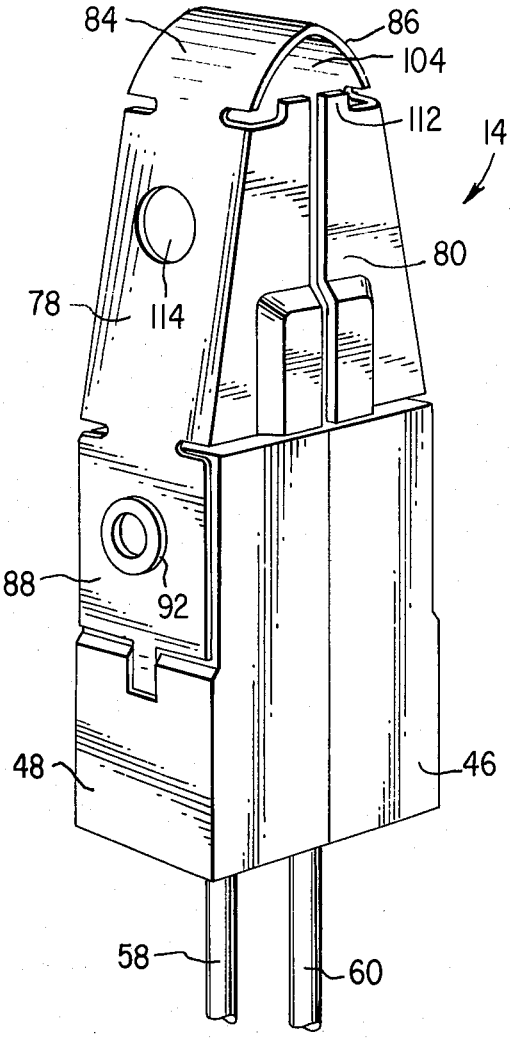
FIG. 3
FIG. 4
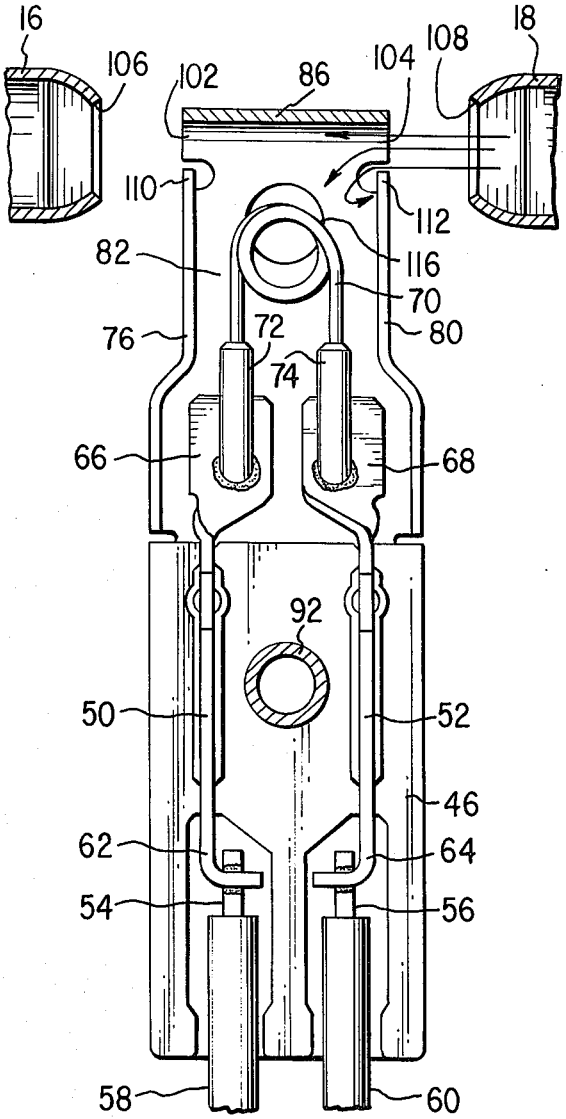

ELECTRIC IGNITION ASSEMBLY

BACKGROUND OF THE INVENTION

1. Field of the Invention:

The invention relates to electric ignition assemblies for gas burners, and in particular, to electric ignition assemblies employing resistance igniter elements.

2. Description of the Prior Art:

Prior art burner systems having a plurality of burners, such as a gas fired cooking-range top, employ a pilot flame with a plurality of flash tubes extending between the pilot flame and the respective burners for directing gaseous fuel from the burners to the pilot flame. U.S. Pat. Nos. 2,705,531 and 3,799,730 disclose ignition systems for multiple fuel burners of a gas range top having an electric resistance igniter to which are directed a plurality of flash tubes from respective ones of the plurality of burners. In such burner systems employing resistance igniter elements, streams of fuel and air impinging directly upon the resistance igniter elements tend to reduce the temperature of the resistance igniter elements which under certain circumstances can reduce the temperatures sufficiently to prevent ignition of the fuel.

One particular solution is to raise the temperature of the igniter sufficiently so that the impinging stream will not lower the temperature of the igniter below ignition temperature; however, such increased temperature causes increased thermal shock as well as increased thermal degradation of the igniter elements, terminals, etc.

In igniter devices for burner systems employing single gaseous burners, as exemplified in U.S. Pat. Nos. 2,850,084, 3,139,558, 3,437,880, and 3,562,590, various shields or hoods, including hoods with openings therein, have been employed to protect the resistance igniter element from direct impingement by a stream of gaseous fuel and air. Such electric resistance igniter devices for single burners are generally not suitable for igniting a plurality of burners. Further, prior art electric resistance igniter devices for single burners generally have one or more deficiencies such as still being subject to substantial cooling by streams of gas and air, being unreliable in insuring flame igniting contact with a sufficient stream of an ignitable mixture, being exposed to drafts, etc.

SUMMARY OF THE INVENTION

The invention is summarized in that an electric ignition assembly for a plurality of burners includes a resistance igniter element; a hood surrounding the igniter element; the hood having a plurality of openings; a plurality of flash conduits, each flash conduit extending between a respective burner and the hood in alignment with a respective opening in the hood for directing unignited fuel from the respective burner to the igniter element; said resistance igniter element being spaced within the hood a predetermined distance away from alignment with each respective conduit and opening; and means for diverting a portion of a respective stream passing through each opening from each respective conduit toward the igniter element.

An object of the invention is to construct an electric ignition assembly for reliably igniting a plurality of burners wherein the assembly utilizes a resistance igniter element which is not subject to cooling and malfunction due to drafts and streams of gas and air.

Another object of the invention is to construct an electric ignition assembly which has substantially improved facilities for directing a stream containing fuel in spaced relationship past a resistance igniter element to avoid direct impingement of the stream on the igniter element.

It is also an object of the invention to provide substantially improved facilities for diverting a portion of a stream containing fuel into engagement with an igniter element to ignite the stream.

An advantage of the invention is that a substantially greater portion of an ignitable stream containing fuel may be brought into substantially closer proximity to an electrical resistance igniter element without causing a substantial reduction in the temperature of the igniter element than has heretofore been possible.

Additional features of the invention include the provision of a hood having a surface portion for extending in alignment with a stream containing fuel to direct the stream in spaced relationship past an igniter element; the provision of a wall for extending contiguous and transverse a stream containing fuel to diverting a portion of the stream of fuel; and the provision of a projection extending into a stream containing a mixture of gaseous fuel and air for turbulating the stream to divert a portion of the stream against an igniter element.

Other objects, advantages and features of the invention will become apparent from the following description when taken in conjunction with the accompanying drawings.

BRIEF DESCRIPTION OF THE DRAWINGS

FIG. 3 is a perspective view of a resistance igniter sub-assembly of the igniter assembly in FIGS. 1 and 2.

FIG. 4 is an elevation cross-section view of the igniter sub-assembly of FIG. 3.

DESCRIPTION OF THE PREFERRED EMBODIMENT

Figure 1:
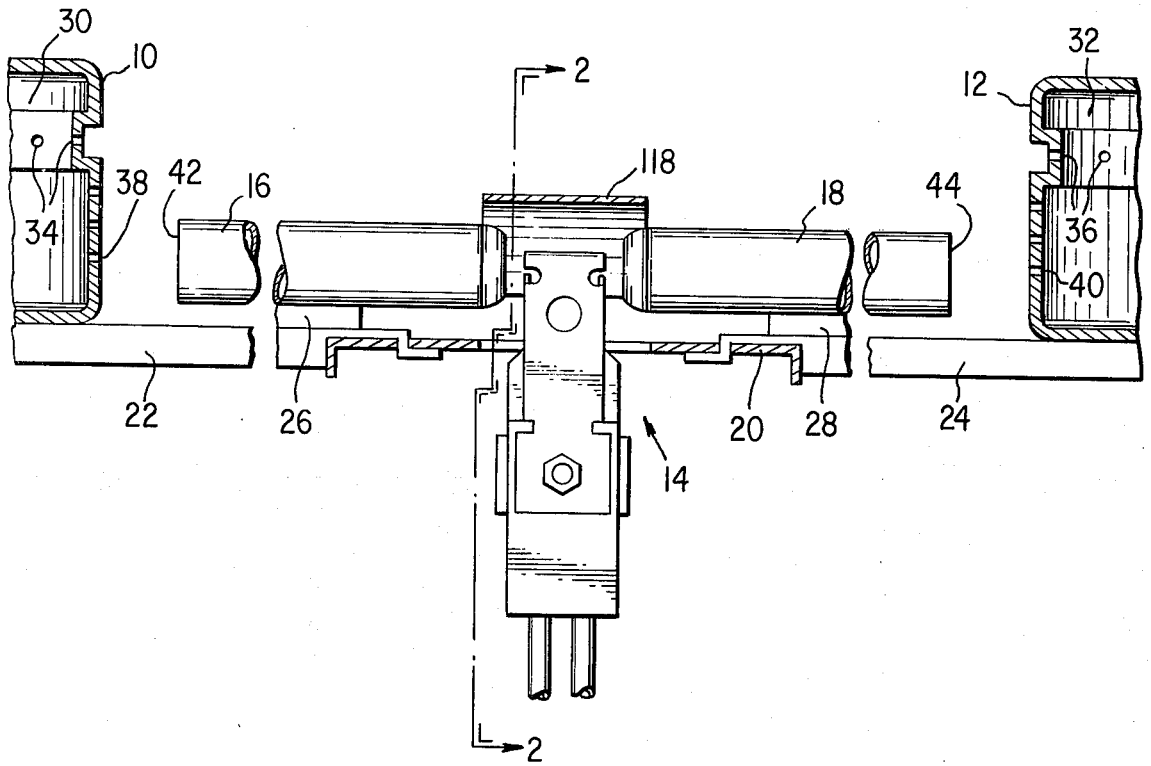
FIG. 1 is a cross-section view in elevation of a broken away portion of a burner system in accordance with the invention.

As illustrated in FIG. 1, the invention is embodied in a top burner system for a cooking range including a pair of burners 10 and 12, an electric resistance igniter sub-assembly 14, and a pair of conduits or flash tubes 16 and 18 extending between the respective burners 10 and 12 and the igniter sub-assembly 14 for directing an ignitable stream containing gaseous fuel from the respective burners 10 and 12 to the igniter sub-assembly 14.

The burner system has an inverted channel-like support 20 upon which support arms 22 and 24 are suitably mounted. The respective burners 10 and 12 are mounted by suitable facilities (not shown) on the ends of the support arms 22 and 24. The flash tubes 16 and 18 are mounted by support blocks 26 and 28 on the respective arms 22 and 24.

The burners 10 and 12 have respective chambers 30 and 32 which communicate with respective conventional gaseous fuel supply and control facilities (not shown). Main burner ports 34 and 36 are formed toward the top portions of the respective burners 10 and 12 around the circumference thereof for producing suitable flames for cooking, or the like. The burners 10 and 12 also have ignition ports 38 and 40 which are aligned with the respective flash tubes 16 and 18 for projecting streams of gaseous fuel mixture into the open ends 42 and 44 of the respective flash tubes 16 and 18 adjacent the respective burners 10 and 12 to create streams of gaseous fuel and air through the flash tubes 16 and 18.

Figure 2:
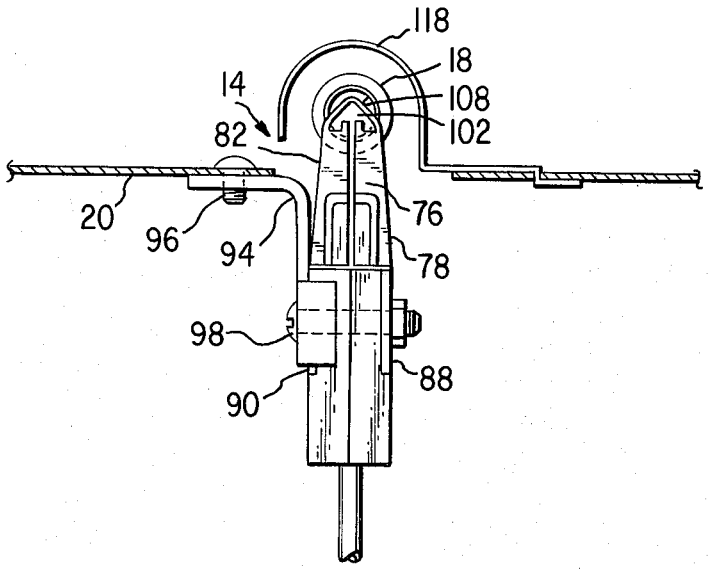
FIG. 2 is a view of an igniter assembly taken along lines 2—2 of FIG. 1.

As illustrated in FIGS. 2, 3 and 4, the igniter subassembly 14 has an insulating member including a pair of insulating blocks 46 and 48 in which respective terminal strips 50 and 52 are suitably retained. Stripped ends 54 and 56 of respective high-temperature insulated conductors 58 and 60 are connected to the lower ends 62 and 64 of the respective terminal strips 50 and 52. Upper ends 66 and 68 of the terminal strips 50 and 52 extend above the insulating blocks 46 and 48. An igniter element 70 has its ends telescoped within respective supporting sleeves 72 and 74. Extreme ends of the element 70 together with the ends of the sleeves 72 and 74 are fused to the upward extending ends of the terminal strips 66 and 68 to fixedly secure the igniter element 70 in an upward extending direction above the insulating blocks 46 and 48.

The burner system has conventional electrical energizing facilities (not shown) connected to the conductors 58 and 60.

The resistance igniter element 70 is preferably a coil formed from an elongated refractory resistance material, such as the commercially available refractory material containing principally molybdenum disilicide together with minor portions of bonding ceramics and the like.

A hood including a generally vertically extending wall having rectangularly disposed walls 76, 78, 80 and 82 and a gabled top including top plate portions 84 and 86 joined at an apex and supported on the upper edges of the walls 78 and 82 surrounds the igniter element 70 in spaced relationship thereto. Supporting wing portions 88 and 90 extend downward from the side walls 78 and 82 on opposite sides of the insulating member. An eyelet 92 secures the wing portions 88 and 90 as well as the insulating blocks 46 and 48 together.

The igniter sub-assembly is mounted on the support 20 by a bracket 94 which is secured by a bolt 96 to the support 20 and by a bolt 98 extending through the eyelet 92.

Generally triangular-shaped openings 102 and 104 are formed between the respective upper edges of the walls 76 and 80 and the top portions 84 and 86 of the hood. The top portions 84 and 86 extend parallel and in alignment with the tubes 16 and 18 and have inside surfaces contiguous the openings 102 and 104. The exit ends 106 and 108 of the respective tubes 16 and 18 are spaced a predetermined distance, for example 3.2 millimeters (0.125 inches), from the respective walls 76 and 80 of the hood as illustrated in FIG. 4. The predetermined distance is selected to produce appreciable streams of gaseous fuel and air mixture from the exit ends 106 and 108 which will not be substantially deviated by minor drafts and currents which may occur in the vicinity of the igniter sub-assembly 14. The axis of the openings 106 and 108 as illustrated in FIG. 2 is generally slightly above the center-of-figure of the openings 102 and 104 and is slightly below the apex of the top sections 84 and 86. The cross-sectional areas of the openings 106 and 108 and the tubes 16 and 18 are illustrated as being slightly larger than the cross-sectional areas of the openings 102 and 104 of the hood.

The size of the openings 102 and 104 in the hood is selected to pass or to allow entrance and exit of at least a substantial portion of the streams from the tubes 106 and 108 in the hood.

The upper edges of the respective walls 76 and 80 extend upward at least to the lower edge of the openings 106 and 108 so as to be contiguous to respective streams issuing from the exit openings 106 and 108. At least the portions of the walls 76 and 80 contiguous the openings 102 and 104 are transverse or substantially perpendicular to the tubes 16 and 18. Projections or tangs 110 and 112 extend centrally from the respective walls 76 and 80 upward into the openings 102 and 104. The tangs 110 and 112 have a size, shape and position particularly insuring that selected portions of the streams are turbulated and diverted when they pass into the openings 102 and 104.

Openings 114 and 116 in respective walls 78 and 82 are located generally at least level with or below the top portion of the igniter element 70. The size of the openings 114 and 116 is selected to allow some air or gas flow from the openings 102 and 104 past the igniter element 70 but restrict any substantial gas flow from the openings 102 and 104 past the igniter element 70.

The hood including the walls 76, 78, 80 and 82 and the top portions 84 and 86 along with the tangs 110 and 112 and the wings 88 and 90 are integrally formed from a metal which has reflective properties to retain radiation within the hood from the igniter element 70. Each of the walls 76 and 80 can be formed from two portions bent into approximate butting relationship. It is noted that the walls 76, 78, 80 and 32 extend above the igniter element and that the igniter element 70 is located a predetermined distance below the upper edges of the walls 76 and 80.

A shield 118 suitably secured to the support 20 extends over the open ends 106 and 108 of the tubes 16 and 18 as well as the upper portion of the hood of the igniter subassembly 14 to protect the streams of gaseous fuel from the flash tubes 16 and 18 from drafts and the like.

In operation of the ignition assembly shown in FIGS. 1, 2, 3 and 4 the igniter element 70 is suitably energized by current through the leads 58 and 60 when a pressurized gaseous fuel mixture is applied into either or both of the chambers 30 and 32 of the burners 10 and 12. Pressurized fuel mixture from the ports 38 and 40 passes into the respective open ends 42 and 44 of the flash tubes 17 and 18 producing streams of fuel mixture progressing to the igniter sub-assembly where the streams are ignited by the igniter element 70 creating a flash of flame through the tubes 16 and 18 thus igniting the fuel mixture issuing from the ports 38 and 40. Once flames from the ports 38 and 40 are ignited the flames will travel upward igniting fuel issuing from the main ports 34 and 36 thus completing ignition of the burners 10 and 12.

In FIG. 4, a gaseous fuel stream is shown passing through the tube 18 out the exit opening 108 and into the opening 104 of the hood. The stream tends to follow the inside surfaces of the portions 84 and 86 directing the stream through the hood a predetermined distance above the igniter element 70. A lower portion of the stream passing over the upper edge of wall 80 is diverted downward by turbuation around the upper edge of the wall 80. The amount of turbulation and hence the diverted portion of the stream is increased a selected amount by the selected size, shape and position of the tang 112. The diverted portion of the stream of fuel engages the igniter element 70 producing ignition of the stream of fuel and air.

It is particularly advantageous that the openings 102 and 104 pass a substantial portion of the streams of fuel mixture from the tubes into the hood; thus there is insured sufficient quantity of ignitable stream to create flash through the openings 102 and 104 back to the burners. The tendency of the streams from the tubes 16 and 18 to follow the inside surface of the portions 84 and 86 and alignment of the openings 102 and 104 with the streams from the tubes 16 and 18 insure that main portions of the ignitable streams in the hood do not impinge directly upon the igniter element 70; thus preventing a substantial reduction in temperature of the igniter element 70 due to the streams of fuel from the tubes 16 and 18. The walls 76 and 80 extending transverse and contiguous to the streams from the tubes 16 and 18, particularly as enhanced by the tangs 110 and 112, produce turbulation and hence diversion of only a selected portion against the igniter element 70, thus there is insured ignition of the streams without any substantial reduction in temperature of the igniter element 70 due to direct engagement with a large ignitable stream. Turbulence of the lower portion of the stream produces a gradient of fuel movement from the stream to the igniter element 70 to enhance ignition.

Further, the openings 114 and 116 having a size selected in accordance with the particular design parameters of the streams through the tubes 16 and 18 enhance the ability to restrict the reduction in igniter temperature while insuring sufficient contact with an ignitable stream. Larger openings are selected for streams which are slow, while smaller openings are selected for streams with greater velocities.

Since many modifications, variations and changes in detail may be made to the presently described embodiment, it is intended that all matter contained in the foregoing description and shown in the accompanying drawings be interpreted as illustrative and not in a limiting sense.

What is claimed is:

1. An electric ignition assembly for a plurality of burners comprising an electric resistance igniter element;

a hood surrounding the igniter element;

said hood having a plurality of openings;

a plurality of flash conduits, each flash conduit extending between a respective burner and the hood in alignment with a respective opening in the hood for directing unignited fuel from the respective burner into the hood;

said resistance igniter element being spaced within the hood a predetermined distance away from alignment with each respective conduit and opening; and means for diverting a portion of a respective stream passing through each opening from each respective conduit toward the igniter element.

2. An electric ignition assembly as claimed in claim 1 wherein the hood includes an inside surface portion extending contiguous each of the plurality of openings and in alignment with each of the plurality of conduits for guiding each respective stream in the hood spaced from the igniter element.

3. An electric ignition assembly as claimed in claim 2 wherein the resistance igniter element is spaced within the hood a predetermined distance in a first direction transverse from alignment with each respective conduit, and the means for diverting a portion of a respective stream includes a wall portion contiguous each of the plurality of openings and extending in the first direction transverse from alignment with each of the plurality of conduits.

4. An electric ignition assembly as claimed in claim 3 wherein each of the plurality of openings is triangular, the inside surface portion extending contiguous each opening extends contiguous two sides of each triangular opening, and the wall portion contiguous each opening extends contiguous the third side of each triangular opening.

5. An electric ignition assembly as claimed in claim 1 wherein the means for diverting at least a portion of a stream passing through each opening includes a respective projection extending into the path of each respective stream.

6. An electric ignition assembly as claimed in claim 5 wherein the hood has top and a wall surrounding the igniter and the plurality of openings are formed in the wall, and the respective projections are integrally formed with the wall and project into the respective openings.

7. An electric ignition assembly as claimed in claim 1 wherein the resistance igniter element is spaced in a first direction away from direct alignment with each respective conduit and opening, and the hood has another opening spaced in a second direction from the igniter element for allowing exit of a diverted portion of the respective stream from the hood such as to allow passage of the diverted portion through the hood for impinging upon the igniter coil.

8. An electric igniter assembly for igniting a stream which contains fuel comprising a resistance igniter element, a hood surrounding the igniter element, said hood positioned in the path of the stream and having a pair of openings in respective opposite sides of the hood in alignment with the path of the stream for allowing entrance and exit of the stream in the hood, said resistance igniter element being spaced a predetermined distance from the path of the stream, and a projection for diverting a portion of the stream in the hood to impinge upon the resistance igniter element.

9. An electric igniter assembly as claimed in claim 8 wherein the projection extends into the entrance opening of the pair of openings for creating turbulence in the stream to divert a portion of the stream to impinge upon the resistance igniter element.

10. An electric igniter assembly as claimed in claim 9 wherein the projection is integrally formed with the hood.

11. An electric igniter assembly for igniting a stream which contains fuel comprising a resistance igniter element, a hood surrounding the igniter element, said hood positioned in the path of the stream and having a pair of openings for allowing entrance and exit of the stream in the hood, said resistance igniter element being spaced a predetermined distance from the path of the stream, a surface portion contiguous the pair of openings in the hood and extending parallel the path of the stream in the hood between the pair of openings for directing the stream in the hood in spaced relationship to the igniter element; and means for diverting a portion of the stream inside the hood to engage the diverted portion against the igniter element.

12. An electric igniter assembly as claimed in claim 11 wherein the means for diverting a portion of the stream inside the hood includes a projection extending into the entrance opening of the pair of openings for creating turbulence in the stream to divert a portion of the stream to engage the igniter element.

13. An electric ignition assembly for a pair of gaseous fuel burners each of which has a plurality of main flame ports and an ignition port for igniting the main flame ports, said assembly comprising, a refractory electrical insulating member, a pair of terminals mounted in spaced relationship on the insulating member, a resistance igniter coil formed from a material containing principally molybdenum disilicide, said igniter coil having respective ends mounted on respective terminals of the pair of terminals, a hood mounted on the insulating member and having four rectangularly disposed walls extending from the insulating member, said hood having a gabled top with a pair of plate portions joined at an apex and mounted at sides opposite the apex of a first opposing pair of the four walls, said hood also having a pair of openings formed in the second opposing pair of walls, said openings in the second pair of walls including triangular portions contiguous the gabled top to form a straight open passageway between the openings in the second pair of walls through the hood beneath the gabled top parallel to the apex, said second pair of opposing walls having straight edge portions bordering the respective openings in the second pair of walls, a tang centrally projecting from each of the straight edge portions into the respective openings in the second pair of walls, said hood and said tangs integrally formed from a metal, said four walls and said gabled top surrounding in spaced relationship the igniter coil such the igniter is spaced from the straight open passageway between the openings in the second pair of walls to reflect radiation from the ignition coil, said refractory electrical insulating member and said hood mounted between the pair of burners such that the passageway between the openings in the second pair of walls is aligned with the ignition ports of the pair of burners, a pair of flash tubes, each of the pair of flash tubes axially aligned with the passageway between the openings in the second pair of walls, each of said flash tubes extending between the ignition port of a respective one of the pair of burners and the opening in a respective one of the second walls, a pair of openings in the first walls spaced from the top by a distance at least equal to the spacing between the igniter coil and the passageway between the openings in the second walls to allow diverted gaseous fuel flow against the igniter coil, and said pair of openings in the first walls having a size restricting free flow of a gas and preventing excessive loss of radiation.

14. An electric ignition assembly as claimed in claim 13 including a shield surrounding the gabled top of the hood and the end portions of the pair of flash tubes adjacent the hood.

* * * * *